United States Patent [19]

Barlow

[11] 4,250,578

[45] Feb. 17, 1981

[54] PROTECTIVE KNEE SUPPORT

[76] Inventor: Carl S. Barlow, Rte. 2, Box 187-36, Sandpoint, Id. 83864

[21] Appl. No.: 21,218

[22] Filed: Mar. 16, 1979

[51] Int. Cl.[3] ..... A41D 13/06

[52] U.S. Cl. ..... 2/24; 128/80 C

[58] Field of Search ..... 2/24, 22, 16, 20, 2; 128/80 C

[56] References Cited

U.S. PATENT DOCUMENTS

| | | | |
|---|---|---|---|
| 3,322,873 | 5/1967 | Hitchcock | 2/24 X |
| 3,945,047 | 3/1976 | Jarrell | 2/24 |
| 4,068,312 | 1/1978 | Ledesma | 2/24 |

*Primary Examiner*—H. Hampton Hunter

*Attorney, Agent, or Firm*—Wells, St. John & Roberts

[57] ABSTRACT

A support for encircling the knee to give support and protection to both the skeletal and muscular structure of the joint. The support includes a tubular device having several separate resilient protective pads attached thereto. A patella cover pad member is positioned on the anterior side of the support to cover and protect the patella and its retinaculum. Medial and lateral pad members are positioned on the strap to engage the knee, extending rearwardly over medial and lateral sides thereof from the patella cover member. The posterior surface of the knee is covered by a flexure pad member. The several independent members allow flexion and extension of the leg while providing both support and protective padding for the knee joint.

12 Claims, 9 Drawing Figures

PROTECTIVE KNEE SUPPORT

BACKGROUND OF THE INVENTION

The present invention relates to the field of knee supports.

In many athletic activities the knee joint is subjected to extraordinary strain and tension. The knees may also be subjected to sudden blows or impacts.

Knee braces have been developed to simulate the natural adduction and abduction of the leg while providing lateral stability at the knee joint. Such structures often are comprised of two hinged plates that are strapped to the lateral and medial sides of the knee by an elastic band. Such supports are serviceable to provide lateral stability but, due to the rigid metallic construction, do not easily conform to lateral expansion of the skin and surface tissues at the knee and will therefore chafe against the knee during active use. The metallic structures have to be precisely positioned with respect to the several axes of rotation for the knee or they will move longitudinally upon flexion and extension, chafing in another direction.

Flexible knee pads have been developed in conjunction with an elastic strap for mounting the pads to the wearer's knees. Such pads typically extend from positions well above the distal end of the femur to ends well below the proximal end of the tibia. Flexible knee pads are essentially bulky and cover only the anterior portion of the knee, leaving the lateral, medial and posterior areas unprotected. Flexible knee pads also hamper normal flexion of the knee.

The sport of football is notable for the use of knee pads and also for knee injuries. Various institutions, particularly college and secondary schools, explicitly require the use of knee pads as part of the football player's gear. Typically, the conventional form of football knee pad is a somewhat circular pad of resilient foam material fitted within a pocket in the pants and held in place either by tape or by an elastic band. Again, such pads do not offer lateral protection to the knee or any form of protection at other than the anterior surfaces. Of course the additional forms of knee braces are also used, especially in cases of weak knees or previous injuries where the player's knees require additional support or protection.

Conventional pads and braces are designed to either support or protect the wearer's knee but seldom are both features to be found in a single arrangement. Existing pads and support arrangements will continually ride up or down the wearer's leg, causing him to continually reach down to adjust the brace to its proper position. The presence of a pad or brace can also break the wearer's concentration and therefore affect his performance.

The present knee support was conceived to provide protective padding and knee bracing functions in order to both protect and stabilize the wearer's knee in virtually any active sport.

BRIEF DESCRIPTION OF THE DRAWINGS

A preferred embodiment of the present invention is illustrated in the accompanying drawings in which.

DETAILED DESCRIPTION OF A PREFERRED EMMBODIMENT

Figure 1:
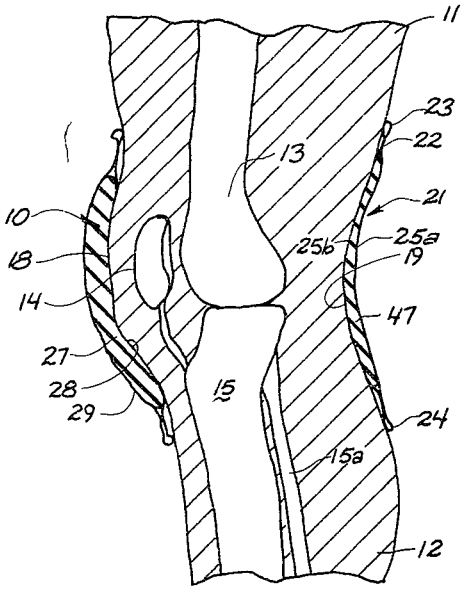
FIG. 1 is a sectioned view illustrating the medial aspect of the right knee joint with the present support fitted thereto.
Figure 2:
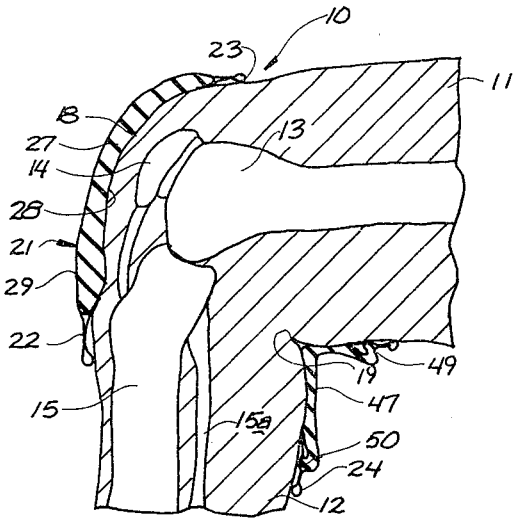
FIG. 2 is a view similar to FIG. 1 only showing the sectioned joint and the present support in position with the leg in flexion.
Figure 3:
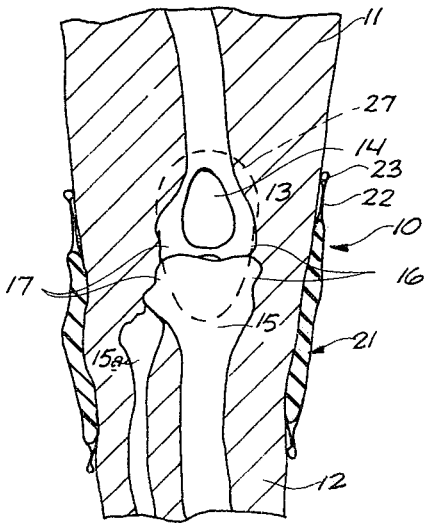
FIG. 3 is a sectional view illustrating the anterior aspect of the knee joint and placement of the present support.
Figure 4:
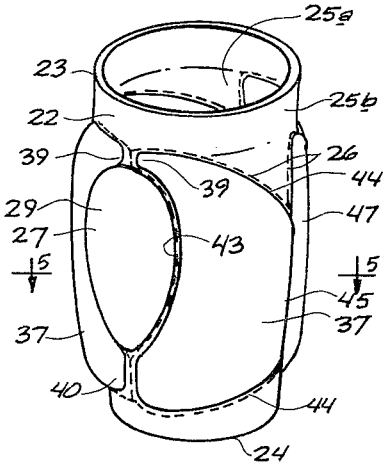
FIG. 4 is an isometric view of the present support.
Figure 5:
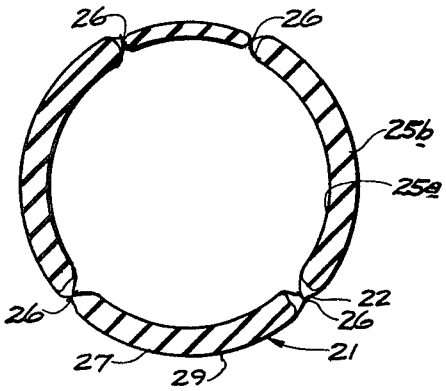
FIG. 5 is a vertical section view taken substantially along 5—5 in FIG. 4.

A knee structure is illustrated in simplified form in the present drawings and is generally designated therein by the reference character 10. For ease of description, a rigid knee is illustrated. The knee 10 is situated between the thigh 11 and calf 12, at the distal end of the femur 13 and at the proximal end of the tibia 15 and fibula 15*a*. The patella 14, frequently referred to as the knee cap, is situated substantially anterior of the junction between the femur end 13 and proximal tibia end 15. The knee joint includes medial condyles 16 and lateral condyles 17 (FIG. 3). An anterior knee surface is generally shown at 18 and a posterior surface is shown at 19 in FIGS. 1 and 2.

The present support, generally designated with the numeral 21, is provided to embrace the knee 10 from the thigh 11 to the calf 12. Its purpose is to provide both protective padding for the knee area and to brace and support the knee joint.

The present support 21 includes an elastic device 22 that is provided to extend from an upper elastic edge 23 on the thigh 11 to a lower elastic edge 24 on the calf 12. It is preferred that the strap 22 circumscribe the knee joint and be formed of a tubular elastic fabric that is air permeable. Such fabric is available currently for covering wrists, knees, and ankles or other joints to support such joints. The fabric may be either of cotton or nylon fabric or a mixture of both that is interwoven with rubber strands in such a manner that expansion will be allowed in the radial direction. The fabric of the present strap is arranged with lateral rubber strands encircling its periphery. The lateral elastic nature of the strap will allow expansion and contraction of the knee in cross section during extension and flexion of the leg. Circumferential elasticity of the device serves to maintain the support in engagement with the knee surfaces while securely holding the support against vertical movement relative to the knee joint. The specific elements comprising the remainder of the present invention also aid to this end.

Preferably, the device 22 is formed of two coaxial tubular fabric layers, one forming an inner layer 25*a* and the other forming an outer layer 25*b*. The layer 25*a* and 25*b* may be secured together by stitching 26. Preferably the stitching 26 is performed to form a plurality of individual pockets circumferentially about the strap. Preferably the individual pockets are enclosed. Alternatively the inner layer 25*a* may be formed of individual pieces that are utilized to form the individual pockets in conjunction with the outer layer 25b.

Enclosed in a front or knee cap pocket between elastic edges 23 and 24 is a patella cover pad member 27. The patella cover pad member 27 is illustrated in substantial detail in FIGS. 1, 2, 4 and 9. it is constructed of a flexible resilient pad material in a general ovoid shape. The pad member 27 spans the anterior side of the patella and its immediate retinaculum, overlapping the proximal end of the tibia 15 at one end and extending above the proximal end of the patella 14.

The patella cover pad member 27 includes a concave surface 28 that generally conforms to the anterior curvature of the knee. Pad 27 is held in position relative to the device within the knee cap pocket.

The inner layer 25a and outer layer 25b hold the knee cap cover pad 27 firmly in position to prevent the patella from moving laterally. Patellar subluxation is thus avoided through firm engagement of the patella by the patella cover pad member 27. Furthermore, the structure of the cover pad member 27 acts as effective padding to prevent injury from impact to the covered area of the knee.

The device 22 will expand due to lateral enlargement of the knee due to flexion of the leg. Expansion will occur equally on opposite sides of the pad member 27 thereby allowing the pad member 27 to remain in proper lateral position with regard to the patella and other covered tissues. The pad 27 will bend with extension and flexion of the leg to minimize any sliding of the member 27 on the adjacent surface tissues of the knee. The elastic nature of the strap 22 holds the member 27 in place against gravity and downward shock incurred by running and jumping.

Figure 8:
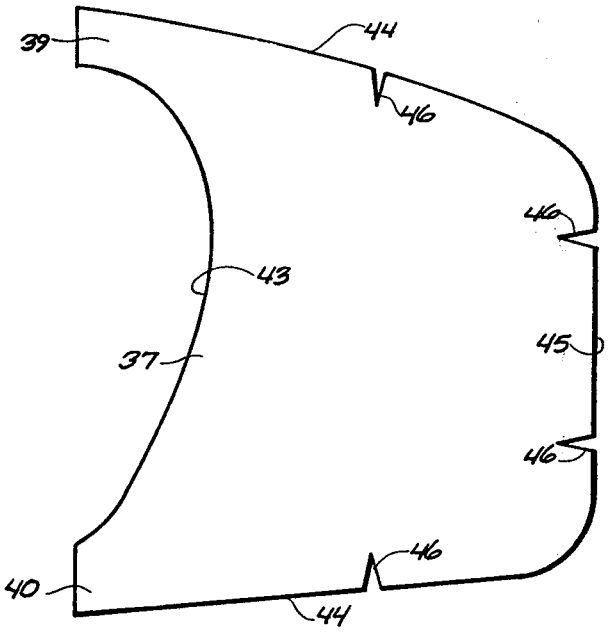
FIG. 8 is an enlarged detail view of a lateral pad member, the opposite member being a mirror image thereof.

The patella cover pad member 27 is at least partially peripherally circumscribed by lateral and medial pad members 37. The lateral and medial supportive members 37 are preferably independent from one another and from the patella cover pad member 27. Each pad member 37 is received within a separate pocket formed within the device along the lateral and medial surfaces of the knee. FIG. 8 illustrates one pad member 37 in detail. The pad member 37 opposite to the one shown in FIG. 8 is a mirror image thereof.

Each pad member 37 includes an upper extension 39 and a bottom extension 40. The upper extensions 39 of the members 37 are positioned in close proximity to one another above the pad member 27. They overlap areas of the thigh upwardly adjacent to the patella.

Pockets are defined by the stitching 26 in the strap 27 to secure the pad members 37 relative to each other and to the patella cover pad member 27. A slight space or gap (FIG. 4) is provided between the adjacent ends of the upper extensions 39 (FIG. 4) to facilitate elastic expansion in response to flexion of the leg.

The bottom extensions 40, on the other hand, can be closely spaced or joined, because the cross-sectional expansion of the calf during leg flexion is not so extensive as the lower thigh areas. Therefore, the bottom extensions 40 may be joined together, or for that matter, may be integral. Preferably the pad members 37 are slightly separated at the bottom extensions 40 by the stitching 26 to hold the individual members 37 in place with respect to the patella cover pad member 27 and with respect to the wearer's knee.

Both pad members 37 are somewhat "D" shaped with concave sides 43 extending partially about the periphery of the patella cover member 27 that are complementary to the ovoid shape of the member 27. Each member 37 also includes rearwardly converging angulated top and bottom edges 44 that lead to upright back edges 45.

A series of notches 46 are formed in the edges 44 and 45 of each member 37 in spaced relation thereon. The notches 46 are V-shaped and extend into the member 37 through its thickness to facilitate flexure of the member in response to flexure and extension of the wearer's leg. During leg flexion the notch sides will move together. During leg extension, the notch sides will move back to the original open configuration. The notches 46 do not substantially affect the lateral stability of the members.

The lateral and medial pad members 37 include sufficient rigidity to add lateral stability to the knee structure while remaining sufficiently flexible to allow relatively free normal extension and flexion of the leg. The resilient nature of the members 37 also protects the knee structure from impact injuries.

The edges 45 of the lateral and medial pad members 37 correspond to the location of the intersection of the lateral and medial surfaces and the posterior knee surface 19 of the leg. Preferably, the location of the upright back edges 45 in relation to the wearer's knee is slightly posterior to an upright plane that is tangential to the posterior surfaces of the medial and lateral condyles 16 and 17.

Figure 6:
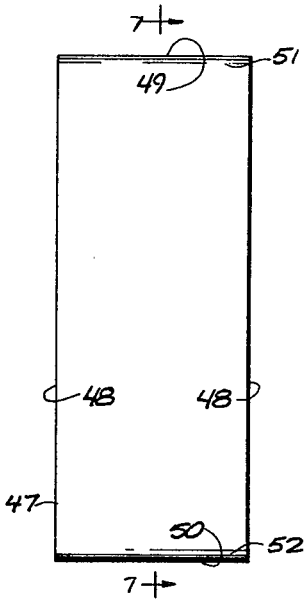
FIG. 6 is an enlarged elevational view of a flexion pad of the present support.

Spanning the lateral distance between the edges 45 is an elongated flexion pad member 47. Pad member 47 is carried within a closed pocket between the layers of the strap 22. Member 47 is upright in orientation and includes upright longitudinal sides 48 (FIG. 6) that are spaced slightly from adjacent upright back edges 45 of the pad members 37. The flexion member 47 includes a top edge 49 and a bottom edge 50.

Figure 7:
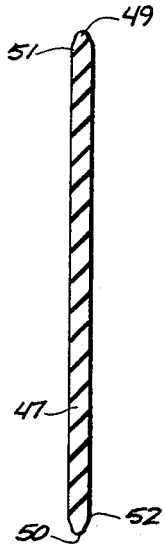
FIG. 7 is a sectional view taken through line 7—7 in FIG. 6.
Figure 9:
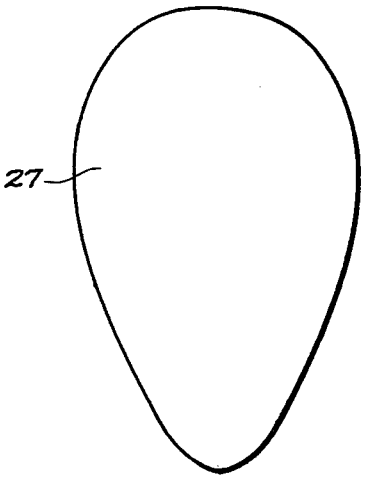
FIG. 9 is an enlarged detailed view of a patella cover pad member for the present support.

The flexion member 47 is elongated with the length being substantially greater than the distance of edge 45 so that the edges 49, 50 extend above and below the intersection of the edges 44 and 45 respectively to provide additional protection to the posterior surface. The flexion member 47 is tapered at 51 and 52 (FIG. 7) on the top and bottom edges 49 and 50 respectively. The tapered edges assure increased flexibility of the member 47 at its ends. The tapered ends will not bind or wedge themselves into adjacent flesh as the knee is flexed. Instead, the member will assume a smooth radius of curvature (FIG. 2). This adds to the comfort of the wearer and further assures that the support will not "creep" in response to continuous flexure of the wearer's knee.

The flexion member 47 includes the further feature of providing a protective padding along the posterior surface of the wearer's knee to protect that sensitive area from injury by forcible impact.

The pad members 27, 37 and 47 are preferably constructed from the same impact absorbant material, such as closed cell plastic foam. Preferably the pad material is closed cell polyethylene or vinyl foam coated with a vinyl coating. One satisfactory brand is "Ensolite."

Applicant has found that closed cell foam having a thickness of between 0.250 inches and 0.500 inches is satisfactory for pad members 27 and 37. It is preferable that pad members 27, 37 have a thickness of 0.375 inches. Pad member 47 is preferably of lesser thickness than members 27 and 37. Applicant has found that pad member 47 operates satisfactory at thicknesses of between 0.1375 inches and 0.3125 inches. A thickness of 0.25 inches is preferred.

The above dimensions are dependent upon the nature of the material forming the pads. The present dimensions are given for members 27, 37 and 47 that are preferably formed of closed cell foamed synthetic resin, preferably a polyethylene or vinyl foamed material. The foamed material is flexible but relatively stiff depending upon its thickness. By providing the flexion member 47 with a thickness dimension less than that of the remaining members, flexibility in the support is provided while maintaining the protective nature of the individual members.

The present support 21 is positioned on the leg simply by inserting the foot through the upper device edge 23, and by pulling the support upwardly to the knee. The support 21 is then shifted up, down or laterally on the knee to bring the patella cover pad member 27 into its proper position over the anterior knee surface, covering the patella. The support 21 will stay in the selected position on the knee due to the elastic nature of the device and insert, and due to the separation of the members 27, 37 and 47.

The patella cover pad member 27 prevents injury from impact to the patellar region by absorbing the impact and distributing it over a wide surface area of the knee. The elastic device 22 holds the concave cover firmly against the patellar area so that member 27 will firmly hold the patella in place, preventing patellar subluxation. The upper and lower extensions of members 37 are also held firmly above and below the member 27 to further assist in preventing sublaxation of the patella.

The lateral and medial pad members 37 provide protection against lateral impact. They also add lateral stability to the knee joint. The notches 46 allow the members to move in response to leg flexure but do not significantly effect their lateral rigidity. Such rigidity is compounded by the curvature of the members about the anterior, lateral, and medial sides of the knee. The members 37 are thereby arched against lateral forces that could otherwise cause ligament damage.

The flexure member 47 protects the knee posterior from impact injuries while allowing substantially free flexure of the leg. Member 47 also aids to prevent hyperflexion of the leg as its resistance to flexure increases with increased flexure of the leg. Hyperextension is resisted on the opposite side of the knee by cover member 27.

Other distinct advantages of the present support have been demonstrated through experimental use. For example, it has been found that the support naturally tends to hold the leg in a normal extended condition and will therefore noticeably assist normal adduction of the leg. This feature is advantageous in preventing fatigue and strain of the adductor muscles of the leg.

The independent, interfitting nature of the several members allows selected flexure of the support without loosing its firm grip on the knee. The support will not noticeably slip either laterally or longitudinally even during rigorous sporting activities such as football and basketball. The wearer therefore can devote his entire concentration to the activity with the assurance that the support will stay in place and protect him effectively against knee injury.

It is to be understood that the above description and attached drawings are given by way of example to set forth a preferred form of my invention. The scope of my invention is set forth in the following claims.

What I claim is:

1. A non-rigid protective knee support, comprising:

an elongated patella cover pad member formed of flexible resilient material to extend over the surface of a knee anterior to the patella;

lateral and medial pad members formed of flexible resilient material positioned on opposite sides of the patella pad member;

said lateral and medial pad members being separate of the patella cover pad member;

a flexion pad member formed of flexible resilient material positioned between and separate from the lateral and medial pad members to cover the posterior surface of the knee;

a tubular elastic device separately mounting the patella cover pad member, lateral and medial pad members, and the flexion member so when the elastic device is placed over a knee, the members will overlap the distal end of the femur and the proximal end of the tibia with (a) the patella pad member extending substantially vertically along the anterior side of the patella, (b) the lateral and medial pad members covering lateral and medial surfaces of the knee between the patella and anterior surfaces of the tibia and femur, (c) the flexion pad member extending between the lateral pad members along the posterior side of the knee to enable the elastic device to stretch between the separated pad members and permit the pad members to flex substantially independently of each other; and said elastic device having a top elastic edge adapted to encircle the thigh above said members and a bottom elastic edge adapted to encircle the calf below said members.

2. The support as defined by claim 1 wherein said members are separated from one another and securely attached to the elastic device within individual pockets formed in the elastic device.

3. The support as defined by claim 1 wherein the flexion pad member is formed of a resilient material having a thickness dimension less than the thickness dimension of the lateral and medial pad members and patella cover pad member.

4. The support as defined by claim 3 wherein the flexion pad member is elongated with upright longitudinal side edges and top and bottom edges and wherein the flexion pad member is tapered at the top and bottom edges.

5. The support as defined by claim 1 wherein the patella cover member is ovoid in shape and separate from the lateral and medial pad members; and wherein the elastic device includes a pocket formed in the device enclosing the patella cover pad member.

6. The support as defined by claim 5 wherein the patella cover pad member is concave to conform with the natural curvature of the anterior knee surface to hold the patella in position during flexion of the associated leg.

7. The support as defined by claim 1 wherein the lateral and medial pad members have top and bottom extensions that project laterally above and below the patella cover pad member to at least partially circumscribe the patella cover pad member.

8. The support as defined by claim 1 wherein the elastic device is formed of an elastic laterally expansible fabric and wherein said members are located in closed pockets of the elastic device.

9. The support as defined by claim 1 wherein the patella cover member and the lateral supportive members are approximately 0.375 inches thick.

10. The support as defined by claim 9 wherein the flexion pad member is approximately 0.25 inches thick.

11. The support as defined by claim 1 wherein the elastic device is formed of an elastic open woven fabric; and wherein said members are separated from one another and are enclosed within individual pockets formed within the fabric.

12. The support as defined in claim 1 wherein the lateral and medial pad members extend rearward from the patella cover pad surface terminating in a rear edge having a preset length and wherein the flexion member has a length substantially greater than the length of the rear edge of the lateral and medial pad members.

* * * * *